United States Patent [19]

Uematsu et al.

[11] Patent Number: 4,803,000

[45] Date of Patent: Feb. 7, 1989

[54] LUBRICANT FOR COLD PLASTIC WORKING OF ALUMINUM ALLOYS

[75] Inventors: Takao Uematsu; Hiroshi Suzuki, both of Hitachi; Shigeki Komatsuzaki, Mito; Fumio Nakano, Hitachi, all of Japan

[73] Assignee: Hitachi, Ltd., Tokyo, Japan

[21] Appl. No.: 875,444

[22] Filed: Jun. 17, 1986

[30] Foreign Application Priority Data

Jun. 19, 1985 [JP] Japan ..... 60-131826

[51] Int. Cl.[4] ..... C10M 105/32; C10M 129/68

[52] U.S. Cl. ..... 252/32.5; 252/51.5 R; 252/51.5 A; 72/42

[58] Field of Search ..... 252/32.5, 49.8, 51.5 R; 72/42

[56] References Cited

U.S. PATENT DOCUMENTS

| | | | |
|---|---|---|---|
| 3,788,988 | 1/1974 | Dubourg | 252/49.9 |
| 3,933,658 | 1/1976 | Beiswanger et al. | 252/32.5 |
| 3,933,660 | 1/1976 | Tadenuma et al. | 252/32.5 |
| 3,945,930 | 3/1976 | Sugiyama et al. | 252/32.5 |
| 4,118,331 | 10/1978 | Jahnke | 72/42 |
| 4,138,346 | 2/1979 | Nassry et al. | 252/32.5 |
| 4,160,089 | 7/1979 | Bussi et al. | 252/32.5 |
| 4,160,370 | 7/1979 | Hacias | 252/32.5 |
| 4,313,836 | 2/1982 | Nassry | 252/32.5 |
| 4,384,965 | 5/1983 | Hellsken et al. | 252/32.5 |
| 4,585,564 | 4/1986 | Tohmato et al. | 252/32.5 |

*Primary Examiner*—William R. Dixon, Jr.
*Assistant Examiner*—Terry D. Johnson
*Attorney, Agent, or Firm*—Antonelli, Terry & Wands

[57] ABSTRACT

A lubricating composition comprising (A) at least one member selected from (a) a polyoxyalkylene alkyl ether phosphate diester, (b) a polyoxyalkylene alkylphenyl ether phosphate diester and (c) a phosphonate ester, in an amount of 3% by weight or more, (B) an N,N'-ethylenebis acid amide having an average particle size of 1 μm or more in an amount of 2 to 15% by weight, and if necessary (C) a lubricating oil having a viscosity of 5 $mm^2/s$ or more (40° C.) is suitable for cold plastic working of aluminum alloys, particularly age-hardening type aluminum alloys, at the reduction of area of 35% or more.

17 Claims, 3 Drawing Sheets

LUBRICANT FOR COLD PLASTIC WORKING OF ALUMINUM ALLOYS

BACKGROUND OF THE INVENTION

This invention relates to a lubricating composition suitable for cold plastic working of aluminum alloys and a process for cold plastic working of aluminum alloys using the same.

Aluminum alloys are light-weight and have good appearance and quality, so that they are widely used as a variety of structural parts in domestic electrical equipments, articles for daily use, cars, communication apparatuses, optical devices, etc. These parts made by plastic working with high productivity. Particularly, cold working can be employed producing advantages in economical efficiency, dimensional accuracy, etc. Most of these worked parts are produced by drawing, ironing, stretching, extrusion, upsetting or the like process.

Heretofore, lubricants for working of aluminum alloys, there have been obtained by adding to a base oil such as a mineral oil, a synthetic oil, or the like an oiliness agent such as a fatty acid, a higher alcohol, or the like an extreme-pressure additive such as tricresyl phosphite, trilauryl phosphite, a chlorinated fat or oil, or the like or a solid lubricant such as graphite, molybdenum disulfide, or the like; or aqueous lubricating oil compositions obtained by adding water to the above-mentioned lubricating oil compositions. These lubricants are useful in rolling and drawing when the reduction of area is about 20% or less, but they are not suitable when the reduction of area becomes higher. Lubricants for ironing and stretching having larger plastic deformation (about 30% in reduction of area) and higher pressure and temperature at working surfaces, have been disclosed in Japanese patent unexamined publication No. 36303/79 where a lubricant is used which comprises a mineral oil, polyoxyalkylene alkyl ether diphosphate ester, a saturated or unsaturated fatty acid, a higher alcohol and a metallic soap.

A lubricating process for working a part with a still higher working ratio, has been proposed wherein a chemical film treated by hydrogen silicofluoride is formed on a surface to be worked, followed by formation of a film of metallic soap or solid lubricant and cold working. But such a process has as a problem the formation of the chemical film.

Prior art lubricants have the problems of that there occur linear scratch, peeling and cracks on the surfaces of products when the reduction of area becomes 35% or more, and the dimensional accuracy is lowered. On the other hand, when the surface to be worked is subjected to the chemical film treatment or metallic soap film treatment, the resistance to seizure is excellent, but the finish peculiar to aluminum cannot be obtained due to the gray treating which remains on the surface of product. Further, there are other disadvantages in that the treating steps become numerous, and it requires high costs and labor to control and handle the treating fluid and to dispose of the waste liquor.

SUMMARY OF THE INVENTION

This inventon provides a lubricating composition suitable for cold plastic working of aluminum alloys with high reduction of area, e.g., 35% or more, particularly of age-hardening type aluminum alloys, and also to provide a process for cold plastic working aluminum alloys using said lubricating composition.

This invention provides a lubricating composition suitable for cold plastic working of aluminum alloys comprising (A) at least one member selected from the group consisting of (a), (b) and (c) in an amount of 3% by weight or more (a) is a polyoxyalkylene alkyl ether phosphate diester represented by the formula:

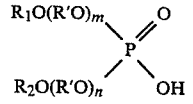

(1)

wherein $R_1$ and $R_2$ are alkyl groups having 12 to 18 carbon atoms; R' is a lower alkylene group; m and n are integers of 1 or more and m+n=2 to 15, (b) is a polyoxyalkylene alkylphenyl ether phosphate diester represented by the formula:

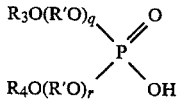

(2)

wherein $R_3$ and $R_4$ are phenylaklyl groups, the alkyl group of which has 8 to 9 carbon atoms; R' is a lower alkylene group; q and r are independently an integers of 1 or more and q+r=2 to 15, (c) is a phosphonic acid ester represented by the formula:

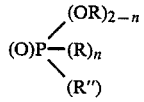

(3)

wherein R and R'' are lower alkyl groups; and n is zero or 1, provided that when n is 1, R'' is OH, (B) an N,N'-ethylenebis acid amide represented by the formula:

$$R_5CONHCH_2CH_2NHCOR_5 \quad (4)$$

wherein $R_5$ is a saturated or unsaturated fatty acid residue having 12 to 22 carbon atoms, and having an average particle size of 1 μm or more in an amount of 2 to 15% by weight, and if necessary, (C) a lubricating oil having a viscosity of 5 $mm^2/s$ or more (at 40° C.).

This invention also provides a process for cold plastic working aluminum alloys using the lubricating oil mentioned above.

DETAILED DESCRIPTION OF THE PREFERRED EMBODIMENTS

Figure 1:
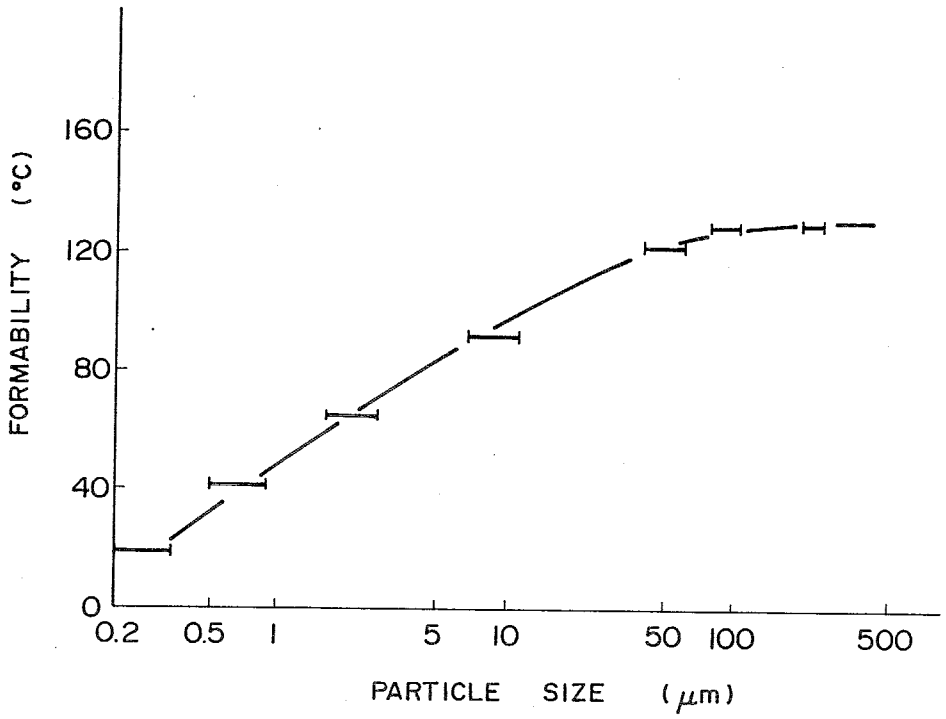
FIG. 1 is a graph showing a relationship between the particle size of the component (B) and the formability in cold working.

The component (A) is at least one member selected from the group consisting of (a) polyoxyalkylene alkyl ether phosphate diesters, (b) polyoxyalkylene alkylphenyl ether phosphate diesters and (c) phosphonic acid esters.

The component (a) is represented by the formula:

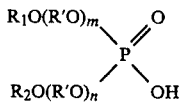

(1)

wherein $R_1$ and $R_2$ are an alkyl groups having 12 to 18 carbon atoms; R' is a lower alkylene group preferably having 2 to 4 carbon atoms, more preferably having 2 carbon atoms; m and n are integer of 1 or more and m+n=2 to 15, preferably 4 to 10. Examples of the phosphate diesters of the formula (1) are polyoxyethylene lauryl ether phosphate ester, polyoxyethylene dodecyl ether phosphate ester, polyoxyethylene palmityl ether phosphate ester, polyoxyethylene stearyl ether phosphate ester, polyoxyethylene oleyl ether phosphate ester, etc.

The component (b) is represented by the formula:

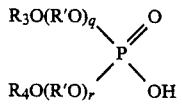

(2)

wherein $R_3$ and $R_4$ are phenylalkyl groups, the alkyl group of which has 8 to 9 carbon atoms; R' is a lower alkylene group preferably having 2 to 4 carbon atoms, more preferably having 2 carbon atoms; q and r are integers of 1 or more and q+r=2 to 15, preferably 4 to 10. Examples of the phosphate diesters of the formula (2) are polyoxyethylene nonylphenyl ether phosphate ester, polyoxyethylene octylphenyl ether phosphate ester, etc.

The phosphate diesters of the formula (1) and (2) may contain mono- or triesters so long as the diesters are the major component.

The component (c) is represented by the formula:

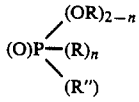

(3)

wherein R and R'' are lower alkyl groups preferably having 4 to 8 carbon atoms; and n is zero or 1, provided that when n is 1, R'' is OH. Examples of the phosphonic acid ester of the formula (3) are 2-ethylhexyl phosphonic acid mono-2-ethylhexyl ester, di-2-ethylhexyl-2-ethylhexyl phosphonate, dibutyl phosphonate, etc.

When the lubricating composition comprises the components (A) and (B), the amount of (A) is 98 to 85% by weight. When the lubricating composition comprises the components (A), (B) and (C), the amount of (A) is 3% by weight or more. In the latter case, when the amount of (A) is less than 3% by weight, the resulting lubricating film formation is insufficient. Since the effect on plastic working is saturated at about 20% by weight of the component (A), an amount more than 20% by weight is superfluous.

As the component (B), there is used an N,N'-ethylenebis acid amide represented by the formula:

$$R_5CONHCH_2CH_2NHCOR_5 \quad (4)$$

wherein $R_5$ is a residue of saturated or unsaturated fatty acid represented by the formula: $R_5COOH$ and having 12 to 22 carbon atoms. Examples of $R_5$ are residues of lauric acid, myristic acid, palmitic acid, stearic acid, hydroxystearic acid, oxystearic acid, behenic acid, oleic acid, ricinoleic acid, octadecadienoic acid, etc.

The content of the N,N'-ethylenebis acid amide of the formula (4) in the lubricating composition is 2 to 15% by weight. When the amount is too small, no effect to formula (4) can be obtained, while when the amount is too large, solidification takes place so as to make coating (or wetting) difficult.

The N,N'-ethylenebis acid amide of the formula (4) should have an average particle size of 1 μm or more in order to give a sufficient lubricating effect at the reduction of area of 35% or more in plastic working. More concretely, in order to produce tape cylinders used in video tape recorders by plastic working a reduction of area of about 40% and a working rate of 30 cylinders per minute at a die temperature of 50°-60° C. (die life: 50,000 cylinders), an average particle size of 2 μm or more is preferable.

It is also preferable that the melting point of N,N'-ethylenebis acid amide of the formula (4) is not lower than 100° C. in order to give a sufficient lubricating effect.

The lubricating composition comprising only the components (A) and (B) can be successfully used in this invention. However, when the component (C), a lubricating oil, is included, additional effects can be obtained. For example, removal of the components (A) and (B) that adhere to surfaces of the aluminum material after working becomes easy, which in turn makes plating or coloring on the worked article easy. Further, when the component (C) is used in an amount making the total 100% by weight together with the components (A) and (B), especially in the range of 50 to 93% by weight, the resulting composition is more economical without lowering the lubricating effect in plastic working. In addition, since the composition is a liquid at room temperature, it has excellent workability.

Component (C), can be oils conventionally used as lubricating oils such as minerals and synthetic oils such as poly-α-olefin oils, ester oils, polybutene oils, polyphenyl ether oils, etc.

The lubricating oils should have a viscosity of 5 CS or more, preferably 10 CS or more, measured at 40° C.

The lubricating composition of this invention can be easily prepared by blending the components (A) and (B). When the component (C) is included in the lubricating composition, it can easily be included by blending.

If precipitation of the component (B), when dispersed in the blended lubricating oil (C), becomes a problem during the step of cold working, a conventionally used dispersing agent may be added to the lubricating composition. One example of the dispersing agent is a chelate compound of alkyl acetate aluminum diisopropylate.

The dispersing agent can be added in an amount of 5 to 15 parts by weight per 100 parts by weight of the component (B).

Plastic working using the lubricating composition of this invention can be carried out as follows. An aluminum alloy material to be worked (workpiece) is coated with the lubricating composition by spraying, brushing, dipping, or the like, on its surface or frictional surface Further, it is effective to coat the frictional surface of a die with the lubricating composition simultaneously with the workpiece. Then, the aluminum alloy material is subjected to cold plastic working.

Thus, even parts having complicated shapes with the reduction of area of 35% or more can be obtained with an excellent finished state on the worked surfaces.

The material to be cold plastic worked, can be conventional aluminum alloys. Particularly good reslts can be obtained for age-hardening type aluminum alloys containing at least one of Cu, Mn, Mg, Fe, Ni, Cr and Si in an amount sufficient for bringing about age-hardening such as Al-Si series containing 4.5 to 13.5% by weight of Si; Al-Cu series containing 1.5 to 6.0% by weight of Cu; Al-Mg series containing 0.2 to 1.8% by weight of Mg; Al-Mn series containing 0.3 to 1.5% by weight of Mn; Al-Mg-Si series containing 0.8 to 1.3% by weight of Mg and 7.8 to 13.5 % by weight of Si, etc.

The good results obtained in plastic working of aluminum alloys by using the lubricating composition of this invention appears to take place for the following reasons.

The component (A) such as a polyoxyalkylene alkyl ether phosphate diester reacts with the surface of aluminum material to be worked due to the heat generated by friction or plastic deformation at the time of plastic working and forms a thin film. A tough lubricant film is formed on the thin film by the component (B), i,e. powder of N,N'-ethylenebis acid amide, which is drawn to the surface of working portion, and thus seizure is prevented by the synergistic effect of the components (A) and (B).

Excellent lubricating effects can also be obtained in plastic working of age-hardening type (or so-called precipitation-hardening type) aluminum alloys, apparently because of good compatibility with elements such as Cu, Mn, Fe, Ni, Si, Mg or Cr included in the aluminum alloys.

in the case of aluminum alloys for cold forging such as those containing 10% by weight or more of Si, annealing is necessary after plastic working in order to remove work strain.

The present invention is illustrated by way of the following Examples, in which all parts and percents are by weight unless otherwise specified.

EXAMPLES 1-20, COMPARATIVE EXAMPLES 1-3

Lubricating compositions were prepared by adding mineral oil having a viscosity of 10 $mm^2/s$ (cSt) at 40° C. to the components (A) and (B) listed in Table 1. For comparison, lubricating compositions as listed in Table 2 were also prepared. Workpieces made of aluminum alloys (A2218(O) and A4032(O): JIS H4040) were coated with these lubricating compositions by dipping at room temperature, and worked under the conditions mentioned below. The surface state, surface roughness of worked surface and formability (or workability) were examined after the working and shown in Table 3. Formability was examined by using a die shown in FIG. 2.

1. Forming Conditions (1) Size of workpiece 2: 20 mm in diameter, 30 mm long and 1.5 μm in average surface roughness.

(2) Material of die 3 and punch 1: SDK 11 (tool steel, JIS G4404)

(i) Die container 6 diameter: 20.1 mm (ii) Punch 1 diameter: 18.4 mm (iii) Reduction of area: 84%

(iv) Down speed of punch 1: 9 mm/sec

2. Surface State

Finished state of surface after the working was observed with the naked eye and evaluated in three stages depending on gloss: ◎ very good (like a mirror), ○ good, and Δ bad (milky white).

3. Surface Roughness

Surface roughness of the inner wall surface of the workpiece perforated by the punch was measured by using an apparatus for measuring roundness (Talyrond 100 type manufactured by Taylor-Hobson Co., Ltd.).

4. Formability

Figure 2:
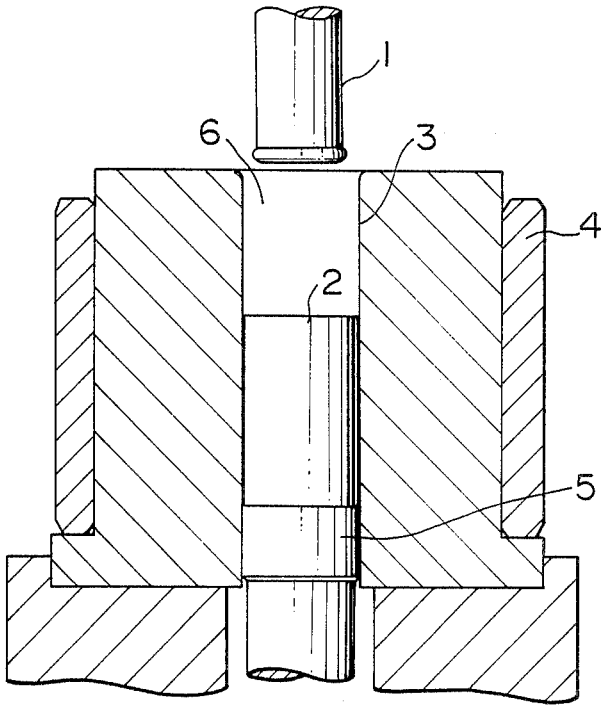
FIG. 2 is a vertical cross-sectional view of a die used for evaluation of properties of lubricants.

The die temperature was raised in stages of 5° to 20° C. for each stage by a band heater 4 attached to a die 3 in FIG. 2. At each temperature level, 10 workpieces coated with a lubricating composition were subjected to plastic forming. After forming, generation of seizure (or galling) was examined. The formability was defined as the highest die temperature which does not generate seizure on the surface of workpieces. The higher the temperature, the better in heat resistance and lubricating properties of the lubricating film formed on the workpiece surface.

As is clear from Table 3, the lubricating compositions of this invention are excellent in the surface state, surface roughness and formability.

TABLE 1

(unit: %)

| | | Example No. | | | | | | | | | | | | | | | | | | | |
|---|---|---|---|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 16 | 17 | 18 | 19 | 20 |
| Component (A) | Polyoxyethylene lauryl ether phosphate diester (EO mole: 4) | | | | | | | 10 | | | | | 5 | | | | | | 10 | | |
| | Polyoxyethylene lauryl ether phosphate diester (EO mole: 10) | | | | | | | | 10 | | | | | | | | 5 | | | | |
| | Polyoxyethylene oleyl ether phosphate diester (EO mole: 4) | 10 | 10 | 10 | 10 | 10 | 10 | | | | | | | | 10 | | | 20 | | 5 | |
| | Polyoxyethylene oleyl ether phosphate diester (EO mole: 10) | | | | | | | | | 10 | | | | 5 | | 5 | | | | | |
| | Polyoxyethylene nonylphenyl ether phosphate diester (EO mole: 4) | | | | | | | | | | 10 | | 5 | | | | | | 10 | | |

TABLE 1-continued (unit: %)

| | | Example No. | | | | | | | | | | | | | | | | | | | |
|---|---|---|---|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 16 | 17 | 18 | 19 | 20 |
| | Polyoxyethylene octylphenyl ether phosphate diester (EO mole: 4) | | | | | | | | | | | 10 | | 5 | | | | | | | 20 |
| Component (B) | N,N'—ethylenebis(lauric acid amide) | 7 | | | | | | 7 | | | | | 7 | 7 | | | | | | | |
| | N,N'—ethylenebis(stearic acid amide) | | 7 | | | | | | 7 | | | | | | 4 | 15 | 2 | | | | |
| | N,N'—ethylenebis(12-hydroxy-stearic acid amide) | | | 7 | | | | | | | | | | | | | | 15 | | | |
| | N,N''—ethylenbis(behenic acid amide) | | | | 7 | | | | | 7 | | | | | 3 | | | | 5 | | 2 |
| | N,N''—ethylenebis(oleic acid amide) | | | | | 7 | | | | | 7 | | | | | | | | 10 | 2 | |
| | N,N''—ethylenebis(ricinoleic acid amide) | | | | | | 7 | | | | | 7 | | | | | | | | | |
| Base oil | Mineral oil (viscosity: 10 $mm^2/s$ at 40° C.) | 83 | 83 | 83 | 83 | 83 | 83 | 83 | 83 | 83 | 83 | 83 | 83 | 83 | 83 | 80 | 93 | 65 | 65 | 93 | 78 |

Note
EO mole: Number of mole of ethylene oxide added.
Particle size of component (B) (av.): 90 m
Diester content in component (A): about 70% (remainder being monoester or triester)

TABLE 2

(unit: parts)

| | Comparative Example No. | 1 | 2 | 3 |
|---|---|---|---|---|
| (i) | Polyoxyethylene oleyl ether phosphate ester (EO mole: 4) | 50 | 47 | |
| | Polyoxyethylene octyl ether phosphate ester (EO mole: 4) | | | 45 |
| (ii) | Palmitic acid | | | 1 |
| | Methyl stearate | | | 3 |
| | Butyl stearate | | 5 | |
| | Octyl stearate | | | 3 |
| | Lauryl alcohol | | 3 | |

TABLE 2-continued (unit: parts)

| | Comparative Example No. | 1 | 2 | 3 |
|---|---|---|---|---|
| (iii)*1 | Zinc oleate | | 10 | |
| | Lead naphthenate | | | 3 |
| | Lead stearate | | 35 | 15 |
| | Iron naphthenate | | | 30 |
| Blending ratio | (i) + (ii) + (iii) | 50 | 20 | 45 |
| | Mineral oil (viscosity: 10 $mm^2/s$ at 40° C.) | 50 | 80 | 55 |

Note
*1Particle size: 10–30 μm

TABLE 3

| Material Item | A2218 (0) Surface state* | A2218 (0) Surface roughness* (μm) | A2218 (0) Formability (°C.) | A4032 (0) Surface state* | A4032 (0) Surface roughness* (μm) | A4032 (0) Formability (°C.) |
|---|---|---|---|---|---|---|
| Comparative Example | | | | | | |
| 1 | ○ | 5.0 | 20*1 | ○ | 5.6 | 20*1 |
| 2 | Δ–○ | 3.1 | 20*2 | Δ–○ | 2.8 | 20*4 |
| 3 | Δ–○ | 1.8 | 40*3 | Δ–○ | 1.5 | 45*5 |
| Example | | | | | | |
| 1 | ○–◎ | 0.32 | 130 | ◎ | 0.22 | 145 |
| 2 | ○–◎ | 0.41 | 120 | ◎ | 0.28 | 125 |
| 3 | ○–◎ | 0.41 | 110 | ◎ | 0.29 | 120 |
| 4 | ○–◎ | 0.43 | 120 | ◎ | 0.30 | 125 |
| 5 | ○–◎ | 0.26 | 100 | ◎ | 0.31 | 100 |
| 6 | ○–◎ | 0.38 | 90 | ◎ | 0.35 | 100 |
| 7 | ○–◎ | 0.33 | 140 | ◎ | 0.25 | 150 |
| 8 | ○–◎ | 0.26 | 115 | ◎ | 0.25 | 125 |
| 9 | ○–◎ | 0.30 | 100 | ◎ | 0.27 | 105 |
| 10 | ○–◎ | 0.38 | 100 | ◎ | 0.31 | 100 |
| 11 | –◎ | 0.42 | 90 | ◎ | 0.35 | 100 |
| 12 | ○–◎ | 0.33 | 145 | ◎ | 0.27 | 150 |
| 13 | ○–◎ | 0.35 | 145 | ◎ | 0.31 | 145 |
| 14 | ○–◎ | 0.45 | 120 | ◎ | 0.37 | 120 |
| 15 | ○–◎ | 0.63 | 130 | Δ–○ | 0.55 | 140 |
| 16 | ○ | 0.28 | 110 | ○ | 0.18 | 115 |
| 17 | ○–◎ | 0.65 | 150 | Δ–○ | 0.48 | 155 |
| 18 | ○–◎ | 0.70 | 115 | Δ–○ | 0.59 | 120 |
| 19 | ○–◎ | 0.30 | 90 | ○–◎ | 0.21 | 100 |

TABLE 3-continued

| Material Item | A2218 (0) Surface state* | A2218 (0) Surface roughness* (μm) | A2218 (0) Formability (°C.) | A4032 (0) Surface state* | A4032 (0) Surface roughness* (μm) | A4032 (0) Formability (°C.) |
|---|---|---|---|---|---|---|
| 20 | ○ | 0.21 | 90 | ○ - ◎ | 0.20 | 90 |

Note on Table 3:
*Properties of finished state of worked surface (surface state able to be worked without seizure)
*[1]Seizure took place at 1st workpiece.
*[2]Seizure took place at 3rd workpiece.
*[3]Seizure took place at 5th workpiece.
*[4]Seizure took place at 2nd workpiece.
*[5]Seizure took place at 4th workpiece.

EXAMPLES 21 TO 29

Polyoxyethylene oleyl ether phosphate diester (number of mole of ethylene oxide added: (4) as the component (A) in an amount of 10% and N,N'-ethylenebis (stearic acid amide) having a particle size of 74–105 μm as the component (B) in an amount of 7% were added to base oils listed in Table 4. The resulting lubricating compositions were coated on workpieces made of A4032(0) and subjected to plastic working under the same conditions as described in Example 1. After the working, the surface state, surface roughness and formability were examined and listed in Table 4.

As is clear from Table 4, the lubricating compositions of this invention are excellent in the surface state and surface roughness as well as formability.

TABLE 4

| Example No. | Base oil | Viscosity: mm2/s (at 40° C.) | Surface state | Surface roughness (μm) | Formability (°C.) |
|---|---|---|---|---|---|
| 21 | Poly α-olefin | 29 | ◎ | 0.37 | 140 |
| 22 | Di-2-ethylhexyl sebacate | 10 | ○ | 0.41 | 120 |
| 23 | Trimethylolpropane tricaprylate | 20 | ○ | 0.50 | 130 |
| 24 | Polybutene | 8 | ◎ | 0.32 | 135 |
| 25 | Polyphenyl ether | 100 | Δ- ○ | 0.55 | 125 |
| 26 | Mineral oil | 50 | ○ - ◎ | 0.33 | 125 |
| 27 | Mineral oil | 80 | ○ - ◎ | 0.32 | 130 |
| 28 | Mineral oil | 150 | ○ - ◎ | 0.41 | 140 |
| 29 | Mineral oil | 210 | ○ - ◎ | 0.48 | 155 |

EXAMPLES 30 TO 42

Lubricating compositions as listed in Table 5 were used for coating workpieces made of A2218(0) by dipping, followed by plastic working in the same manner as described in Example 1.

The surface state, surface roughness and formability were examined in the same manner as described in Example 1 and listed in Table 5. As is clear from Table 5, these lubricating compositions are also excellent in formability.

TABLE 5

| | Compound | Example No. Lubricating composition (%) 30 | 31 | 32 | 33 | 34 | 35 | 36 | 37 | 38 | 49 | 40 | 41 | 42 |
|---|---|---|---|---|---|---|---|---|---|---|---|---|---|---|
| Component A | Polyoxyethylene lauryl ether phosphate diester (EO mole: 4) | 97 | 85 | — | — | 90 | 3 | 50 | 35 | 35 | 35 | 3 | 20 | 20 |
| | Di(2-ethylhexyl) 2-ethylhexylphosphate | — | — | 97 | 85 | 3 | 90 | 35 | 50 | 35 | 35 | 3 | 10 | 20 |
| B | N,N'—ethylenebis(stearic acid amide) (particle size 37–150 μm) | 3 | 15 | 3 | 15 | 7 | 7 | 15 | 15 | 3 | 5 | 3 | 15 | 15 |
| C | Mineral oil (viscosity: 10 mm2/s, 40°) | — | — | — | — | — | — | — | — | 27 | 25 | 91 | 55 | 45 |
| Properties | Surface state | ○ - ◎ | ○ - ◎ | ○ - ◎ | ○ - ◎ | ○ - ◎ | ○ - ◎ | ○ - ◎ | ○ - ◎ | ○ - ◎ | ○ - ◎ | ○ - ◎ | ○ - ◎ | ○ - ◎ |
| | Surface roughness (μm) | 0.20 | 0.35 | 0.19 | 0.33 | 0.18 | 0.19 | 0.22 | 0.34 | 0.25 | 0.23 | 0.20 | 0.28 | 0.27 |
| | Formability (°C.) | 110 | 135 | 115 | 140 | 120 | 125 | 135 | 135 | 125 | 125 | 110 | 130 | 130 |

EXAMPLE 43

Plastic working was carried out by changing the kinds of aluminum alloy materials (workpieces) using the lubricating composition of Example 1 under the same conditions as used in Example 1. The formability was examined and listed in Table 6.

As is clear from Table 6, it is preferable to use only a small amount of the Mg element. But in the case of Al alloys containing Cu and Mn which can form an intermetallic compound, Mg may be included in a relatively large amount. Further, the lubricating compositions of this invention are particularly effective for aluminum alloys of 2000, 3000 and 4000 defined by the standards of JIS and Aluminum Association standards of the United States. These aluminum alloys contain Cu: 1.5 to 6.0%, Mg: 0.2 to 1.8%, Mn: 0.3 to 1.5%, or Si: 4.5 to 13.5% as a second major component after aluminum.

TABLE 6

| Kind of alloy | Alloy No. | Chemical composition (%) Si | Fe | Cu | Mn | Mg | Cr | Zn | Ti | Ni | Al | Formability (°C.) |
|---|---|---|---|---|---|---|---|---|---|---|---|---|
| Al—Cu | 2011(O) | ≦0.40 | ≦0.70 | 5.0–6.0 | — | — | — | ≦0.30 | — | — | Balance | 135 |
| series | 2117(O) | ≦0.8 | ≦0.7 | 2.2–3.0 | ≦0.2 | 0.20–0.50 | ≦0.10 | ≦0.25 | — | — | " | 135 |
| | 2024(O) | ≦0.5 | ≦0.5 | 3.8–4.9 | 0.30–0.9 | 1.2–1.8 | ≦0.10 | ≦0.25 | ≦0.15 | — | " | 130 |
| Al—Mn | 3004(O) | ≦0.30 | ≦0.7 | ≦0.25 | 1.0–1.5 | 0.8–1.3 | — | ≦0.25 | — | — | " | 125 |
| series | 3203(O) | ≦0.6 | ≦0.7 | ≦0.05 | 1.0–1.5 | — | — | 0.10 | — | — | " | 130 |
| | 3105(O) | ≦0.6 | ≦0.7 | ≦0.3 | 0.30–0.8 | 0.20–0.8 | ≦0.20 | ≦0.40 | ≦0.10 | — | " | 130 |
| Al—Si | 4043(O) | 11.0–13.5 | ≦1.0 | 0.5–1.3 | — | 0.8–1.3 | ≦0.10 | ≦0.25 | — | 0.50–1.3 | " | 140 |
| series | 4044(O) | 7.8–9.2 | 0.8 | 0.25 | 0.10 | — | — | 0.20 | — | — | " | 145 |
| Al—Mg series | 5052(O) | ≦0.25 | ≦0.40 | ≦0.10 | ≦0.10 | 2.2–2.8 | 0.15–0.35 | ≦0.10 | — | — | " | 20 |
| Al—Mg—Si series | 6063(T5) | 0.20–0.6 | ≦0.35 | ≦0.10 | ≦0.10 | 0.45–0.9 | ≦0.10 | ≦0.10 | — | ≦0.10 | " | 20 |

EXAMPLE 44

Figure 3:
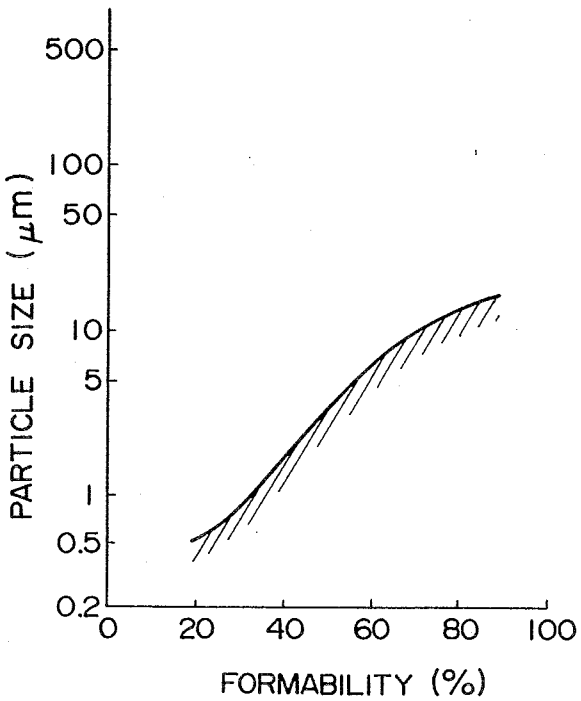
FIG. 3 is a graph showing a relationship between the particle size of the component (B) and the reduction of area.

Relationship between the particle size of the component (B), N,N'-ethylenebis acid amide and the formability is shown in FIG. 3.

FIG. 3 was obtained by examining the relationship of working speed and the particle size of N,N'-ethylenebis acid amide in the case of plastic working at a working speed of 30 parts/min using dies having different reduction of area. As the aluminum alloy material, A2218(0) was used. As the N,N'-ethylenebis acid amide, N,N'-ethylenebis(lauric acid amide) was used. The lubricating composition used was the same as that of Example 1.

Figure 4:
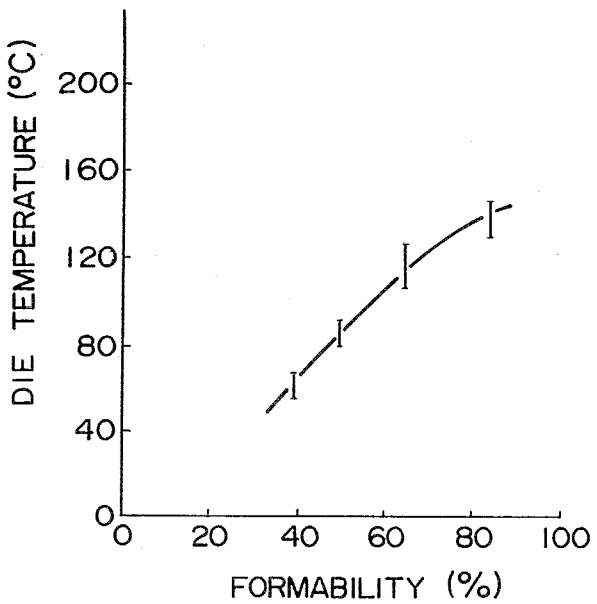
FIG. 4 is a graph showing a relationship between the die temperature and the reduction of area.

The relationship between the formability and the die temperature is shown in FIG. 4.

As shown in FIGS. 3 and 4, the particle size of the N,N'-ethylenebis acid amide is 1 μm, when the reduction of area is 35% and the die temperature is about 50° C. When the reduction of area is about 60%, the particle size becomes 5 μm and the die temperature becomes 100° C.

It is desirable that the film formed on the surface to be plastic worked does not melt at the working temperature. Thus, it is sufficient that the melting point of the N,N'-ethylenebis acid amide be higher than the working temperature. A melting point of 100° C. or higher is preferable.

EXAMPLE 45

Formability of workpieces made of A2218(0) was examined by using the lubricating composition of Example 1 except for changing the particle size of the component (B), N,N'-ethylenebis (stearic acid amide), in the same manner as described in Example 1. The results are shown in FIG. 1.

As is clear from FIG. 1, when the particle size is 0.5 μm, the effect produced by the addition of the component (B) begin to occur and increase. Then the particle size reaches about 40 μm, the formability is saturated.

EXAMPLE 46

To mineral oil having a viscosity of 10 $mm^2/s$ at 40° C., 10% of polyoxyethylene oleyl ether phosphate diester (number of mole of ethylene oxide added: (4) as the component (A) and 10% of acid amides or N,N'-ethylenebis acid amides, as the component (B) as listed in Table 7 having different melting points were added to give lubricating compositions.

Relationship between the melting point of the component (B) and the formability was examined by using workpieces made of A4032(0) in the same manner as described in Example 1. The results are shown in Table 7.

TABLE 7

| Component (B) (average particle size: 100 μm) | Melting point (°C.) | Formability (°C.) |
|---|---|---|
| Linoleic acid amide | 63 | 50 |
| Oleic acid amide | 73 | 65 |
| Stearic acid amide | 102 | 85 |
| N,N'—ethylenebis (oleic acid amide) | 118 | 120 |
| N,N'—ethylenebis (stearic acid amide) | 143 | 130 |
| N,N'—ethylenebis (lauric acid amide) | 157 | 150 |

As is clear from Table 7, with an increase of the melting point of the component (B), the formability increases. A melting point of 100° C. or higher is preferable for the component (B).

EXAMPLES 47 TO 52

Using mineral oil having a viscosity of 32 $mm^2/s$ at 40° C., lubricating compositions as listed in Table 8 were prepared. The metallic soaps and N,N'-ethylenebis acid amides having particle sizes of 44–63 μm (passing 350 to 250 mesh, JIS Z8801) were dispersed in the mineral oil.

After coating these lubricating compositions on workpieces made of an aluminum alloy (JIS A5056), the formability was examined by a forward extrusion method and a backward extrusion method under the conditions mentioned below. The surface state after the working was also examined. The results are shown in Table 9.

1. Forming Conditions:

1.1 Workpiece (1) Forward extrusion:

Material: aluminum alloy (JIS A5056)

Size: 19.9 mm in outer diameter

-continued

| | | |
|---|---|---|
| | | and 20 mm long. |
| | Surface roughness: | max. 2.0 μm |
| (2) | Backward extrusion: | |
| | Material: | aluminum alloy (JIS A5056) |
| | Size: | 19.9 mm in outer diameter and 20 mm long. |
| | Surface roughness: | max. 2.0 μm |
| | 1.2 Die and Sizes of Major Parts | |
| (1) | Forward extrusion: | |
| | Material: | SKD 11 (tool steel, JIS G4404) |
| | Container diameter: | 10 mm |
| | Extrusion angle: | 120° |
| | Drawing diameter: | 6 mm (reduction of area: 64%) |
| (2) | Backward extrusion: | |
| | Material: | SKD 11 (tool steel, JIS G4404) |
| | Container diameter: | 20 mm |
| | Punch diameter: | 16 mm (made of SKD 11) |
| | Reduction of area: | 63.9% |
| 2. Evaluation of Formability: | | |
| The same as in Example 1. | | |

COMPARATIVE EXAMPLES 4 AND 5

Lubricating compositions were prepared by the following formulations:

| | Comparative Example 4 | Comparative Example 5 |
|---|---|---|
| Base oil | mineral oil (50%) | mineral oil (50%) |
| Additive | fatty acid (40%) sulfur series extreme-pressure additive (10%) | fatty acid (50%) |

TABLE 8

| Example No. | 47 | 48 | 49 | 50 | 51 | 52 |
|---|---|---|---|---|---|---|
| Di-2-ethylhexyl-2-ethylhexyl phosphonate | 5 | — | 5 | 10 | 5 | 12 |
| Dibutyl butylphosphonate | — | 5 | — | — | — | — |
| Lithium 12-hydroxystearate | — | — | — | — | — | 7 |
| Sodium terephthalate | — | — | — | — | 3 | — |
| N,N'—ethylenebis (ricinoleic acid amide) | 3 | — | — | — | — | 5 |
| N,N'—ethylenebis (stearic acid amide) | — | 3 | — | 10 | — | — |
| N,N'—hexamethylenebis (12-hydroxystearic acid amide) | — | — | 3 | — | 3 | — |

TABLE 9

| Example No. | Forward extrusion Surface state | Forward extrusion Formability (°C.) | Backward extrusion Surface state | Backward extrusion Formability (°C.) |
|---|---|---|---|---|
| 47 | ◎ | 175 | ○ | 125 |
| 48 | ◎ | 180 | ○ | 115 |
| 49 | ◎ | 180 | ○ | 120 |
| 50 | ○ | 230 | Δ~○ | 125 |
| 51 | ○ | 210 | ○ | 110 |
| 52 | ○ | 230 | Δ~○ | 130 |
| Comparative Example | | | | |
| 4 | Δ~○ | 140 | Seizure | <30 |
| 5 | Δ | 110 | Seizure | <30 |

What is claimed is:

1. In a process for cold plastic working an aluminum alloy comprising age-hardening a workpiece of age-hardening type aluminum alloy, coating the workpiece with a lubricant for plastic working and conducting plastic working, the improvement wherein as the lubricant, there is used a lubricating composition consisting essentially of (A) at least one member selected from the group consisting of (a), (b) and (c) in an amount of 3% by weight or more, (a) a polyoxyalkylene alkyl ether phosphate diester represented by the formula:

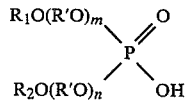

(1)

wherein $R_1$ and $R_2$ are independently an alkyl group having 12 to 18 carbon atoms; R' is a lower alkylene group; m and n are independently an integer of 1 or more and m+n=2 to 15, (b) polyoxyalkylene alkylphenyl ether phosphate diester represented by the formula:

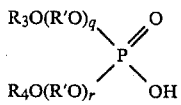

(2)

wherein $R_3$ and $R_4$ are independently a phenylalkyl group, the alkyl group of which has 8 to 9 carbon atoms; R' is a lower alkylene group; q and r are independently an integer of 1 or more and q+r=2 to 15, (c) a phosphonic acid ester represent by the formula:

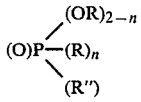

(3)

wherein R and R'' are independently a lower alkyl group; and n is zero or an integer of 1, provided that when n is 1, R'' is OH, (B) an N,N'-ethylenebis acid amide represented by the formula:

$$R_5CONHCH_2CH_2NHCOR_5 \quad (4)$$

wherein $R_5$ is a saturated or unsaturated fatty acid residue having 12 to 22 carbon atoms, and having an average particle size of 1 μm or more in an amount of 2 to 15% by weight, and (C) a lubricating oil having a viscosity of 5 CS or more at 40° C. in an amount to make the composition 100% by weight.

2. A process according to claim 1, wherein the N,N'-ethylenebis acid amide is a powder having an average particle size of 2 μm or more and a melting point of 100° C. or higher.

3. A process according to claim 1, wherein m+n in the formula (1) is 4 to 10 and q+r in the formula (2) is 4 to 10.

4. A process according to claim 1, wherein the aluminum alloy is an age-hardening type aluminum alloy containing at least one element selected from the group consisting of Cu, Mn, Mg and Si in an amount sufficient for causing age-hardening.

5. A process according to claim 1, wherein the aluminum alloy is an age-hardening aluminum alloy of Al-Si series containing 4.5 to 13.5% by weight of Si, Al-Cu series containing 1.5 to 6.0% by weight of Cu, Al-Mg series containing 0.2 to 1.8% by weight of Mg or Al-Mn series containing 0.3 to 1.5% by weight of Mn.

6. A process according to claim 1, wherein (a) is selected from the group consisting of polyoxyethylene lauryl ether phosphate ester, polyoxyethylene dodecyl ether phosphate ester, polyoxyethylene palmityl ether phosphate ester, polyoxyethylene stearyl ether phosphate ester, and polyoxyethylene oleyl ether phosphate ester; (b) is selected from the group consisting of polyoxyethylene nonylphenyl ether phosphate ester, and polyoxyethylene octylphenyl ether phosphate ester; and (c) is selected from the group consiting of 2-ethylhexyl phosphonic acid mono-2-ethylhexyl ester, di-2-ethylhexyl-2-ethylhexyl phosphonate, and dibutyl phosphonate.

7. A process according to claim 1, wherein $R_5$ is selected from the group consisting of residues of lauric acid, myristic acid, palmitic acid, stearic acid, hydroxystearic acid, oxystearic acid, behenic acid, oleic acid, ricinoleic acid, and octadecadienoic acid.

8. A lubricating composition suitable for cold plastic working of aluminum alloys consisting essentially of (A) at least one member selected from the group consisting of (a), (b) and (c) in an amount of 98 to 85% by weight, (a) a polyoxyalkylene alkyl ether phosphate diester represented by the formula:

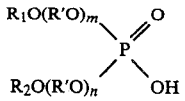

(1)

wherein $R_1$ and $R_2$ are independently an alkyl group having 12 to 18 carbon atoms; R′ is a lower alkylene group; m and n are independently an integer of 1 or more and m+n=2 to 15, (b) a polyoxyalkylene alkylphenyl ether phosphate diester represented by the formula:

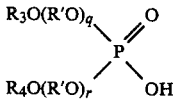

(2)

wherein $R_3$ and $R_4$ are independently a phenylalkyl group, the alkyl group of which has 8 to 9 carbon atoms; R′ is a lower alkylene group; q and r are independently an integer of 1 or more and q+r=2 to 15, (c) a phosphonic acid ester represented by the formula:

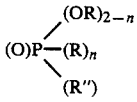

(3)

wherein R and R″ and independently a lower alkyl group; and n is zero or an integer of 1, provided that when n is 1, R″ is OH, and (B) an N,N′-ethylenebis acid amide represented by the formula:

$$R_5COHNCH_2CH_2NHCOR_5 \quad (4)$$

wherein $R_5$ is a saturated or unsaturated fatty acid residue having 12 to 22 carbon atoms, and having an average particle size of 1 μm or more in an amount of 2 to 15% by weight.

9. A lubricating composition according to claim 8, wherein the N,N′-ethylenebis acid amid is a powder having an average particle size of 2 μm or more and a melting point of 100° C. or higher.

10. lubricating composition according to claim 8, wherein m+n in the formula (1) is 4 to 10 and q+r in the formula (2) is 4 to 10.

11. A lubricating composition according to claim 8, wherein (a) is selected from the group consisting of polyoxyethylene lauryl ether phosphate ester, polyoxyethylene dodecyl ether phosphate ester, polyoxyethylene palmityl ether phosphate ester, polyoxyethylene stearyl ether phosphate ester, and polyoxyethylene oleyl ether phosphate ester; (b) is selected from the group consisting of polyoxyethylene nonylphenyl ether phosphate ester, and polyoxyethylene octylphenyl ether phosphate ester; and (c) is selected from the group consisting of 2-ethylhexyl phosphonic acid mono-2-ethylhexyl ester, di-2-ethylhexyl-2-ethylhexyl phosphonate, and dibutyl phosphonate.

12. A lubricating composition according to claim 8, wherein $R_5$ is selected from the group consisting of residues of lauric acid, myristic acid, palmitic acid, stearic acid, hydroxystearic acid, oxystearic acid, behenic acid, oleic acid, ricinoleic acid, and octadecadienoic acid.

13. In a process for cold plastic working an aluminum alloy comprising age-hardening a workpiece of age-hardening type aluminum alloy, coating the workpiece with a lubricant for plastic working and conducting plastic working, the improvement wherein as the lubricant, there is used a lubricating composition consisting essentially of (A) at least one member selected from the group consisting of (a), (b) and (c) in an amount of 98 to 85% by weight, (a) a polyoxyalkylene alkyl ether phosphate diester represented by the formula:

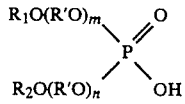

(1)

wherein $R_1$ and $R_2$ are independently an alkyl group having 12 to 18 carbon atoms; R′ is a lower alkylene group; m and n are independently an integer of 1 or more and m+n=2 to 15, (b) a polyoxyalkylene alkylphenyl ether phosphate diester represented by the formula:

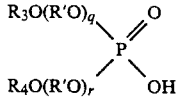

(2)

wherein $R_3$ and $R_4$ are independently a phenylalkyl group, the alkyl group of which has 8 to 9 carbon atoms; R′ is a lower alkylene group; q and r are independently an integer of 1 or more and q+r=2 to 15, (c) a phosphonic acid ester represented by the formula:

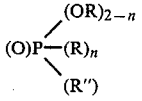

(3)

wherein R and R″ are independently a lower alkyl group; and n is zero or an integer of 1, provided that when n is 1, R″ is OH, and (B) an N,N′-ethylenebis acid amide represented by the formula:

$$R_5CONHCH_2CH_2NHCOR_5 \quad (4)$$

wherein $R_5$ is a saturated or unsaturated fatty acid residue having 12 to 22 carbon atoms, and having an average particle size of 1 μm or more in an amount of 2 to 15% by weight.

14. A process according to claim 13, wherein the aluminum alloy is an age-hardening type aluminum alloy containing at least one element selected from the group consisting of Cu, Mn, Mg and Si in an amount sufficient for causing age-hardening.

15. A process according to claim 13, wherein the aluminum alloy is an age-hardening aluminum alloy of Al-Si series containing 4.5 to 13.5% by weight of Si, Al-Cu series containing 1.5 to 6.0% weight of Cu, Al-Mg series containing 0.2 to 1.8% by weight of Mg or Al-Mn series containing 0.3 to 1.5% by weight of Mn.

16. A process according to claim 13, wherein (a) is selected from the group consisting of polyoxyethylene lauryl ether phosphate ester, polyoxyethylene dodecyl ether phosphate ester, polyoxyethylene palmityl ether phosphate ester, polyoxyethylene stearyl ether phosphate ester, and polyoxyethylene oleyl ether phosphate ester; (b) is selected from the group consisting of polyoxyethylene nonylphenyl ether phosphate ester, and polyoxyethylene octylphenyl ether phosphate ester; and (c) is selected from the group consisting of 2-ethylhexyl phosphonic acid mono-2-ethylhexyl ester, di-2-ethylhexyl-2-ethylhexyl phosphonate, and dibutyl phosphonate.

17. A process according to claim 13, wherein $R_5$ is selected from the group consisting of residues of lauric acid, myristic acid, palmitic acid, stearic acid, hydroxystearic acid, oxystearic acid, behenic acid, oleic acid, ricinoleic acid, and octadecadienoic acid.

* * * * *